United States Patent [19]

Cotic

[11] 4,276,476

[45] Jun. 30, 1981

[54] RADIATION DETECTOR HAVING A UNITARY FREE FLOATING ELECTRODE ASSEMBLY

[75] Inventor: Dennis J. Cotic, Milwaukee, Wis.

[73] Assignee: General Electric Company, Milwaukee, Wis.

[21] Appl. No.: 971,200

[22] Filed: Dec. 20, 1978

[51] Int. Cl.[3] ..... H01J 39/28

[52] U.S. Cl. ..... 250/385

[58] Field of Search ..... 339/93 R, 93 C; 250/385, 389, 381, 445 T, 521; 340/629; 313/383, 369; 248/560, 634, 632, 638, 603, 614, 568, 569

[56] References Cited

U.S. PATENT DOCUMENTS

| | | | |
|---|---|---|---|
| 2,462,272 | 2/1949 | Martin | 248/568 |
| 2,702,891 | 2/1955 | Lasho | 339/93 R |
| 3,137,803 | 6/1964 | Ney et al. | 313/383 |
| 3,619,685 | 11/1971 | Miller | 313/269 |
| 4,004,151 | 1/1977 | Novak | 250/487 |
| 4,089,045 | 5/1978 | Mars | 313/269 |
| 4,119,853 | 10/1978 | Shelley et al. | 250/385 |
| 4,158,773 | 6/1979 | Novak | 250/521 |

FOREIGN PATENT DOCUMENTS

| | | | |
|---|---|---|---|
| 2744831 | 6/1978 | Fed. Rep. of Germany | 250/381 |
| 529334 | 7/1975 | U.S.S.R. | 248/569 |

*Primary Examiner*—Alfred E. Smith
*Assistant Examiner*—Carolyn E. Fields
*Attorney, Agent, or Firm*—Douglas E. Stoner; Dana F. Bigelow

[57] ABSTRACT

A multicell x-ray radiation detector includes a chamber for confining a gas that produces electron-ion pairs incidental to absorbing radiation. The chamber is formed by a channel having a bottom and sidewalls, one of the side walls having a window for admitting radiation to the chamber. A multicell unitary electrode assembly is mounted within the chamber. An upper compressed elastic member is interposed between the electrode assembly and the chamber and, similarly, a rear compressed elastic member is interposed between the assembly and the sidewall opposite the window of the chamber. The compressed elastic members interposed between the electrode assembly and the chamber isolate the electrode assembly from any mechanical vibration and thermal distortion of the chamber while maintaining a precise position of the electrode assembly to the chamber window.

9 Claims, 3 Drawing Figures

RADIATION DETECTOR HAVING A UNITARY FREE FLOATING ELECTRODE ASSEMBLY

BACKGROUND OF THE INVENTION

This invention relates to detectors for ionizing radiation, such as x-ray and gamma radiation. The invention is concerned with improving multicell detectors by minimizing thermal and microphonic instabilities of the detectors.

The detectors have various uses but are especially useful in x-ray computed axial tomography systems. In the computed axial tomography process, a spatial distribution of x-ray photon intensities merging from a body under examination are translated into analog electric signals which are processed in a manner that enables reconstructing the x-ray image and displaying it as a visible image. Background information on the process is given in an article by Gordon, et al., "Image Reconstruction from Projections," Scientific American, Oct. 1975, Vol. 233, No. 4.

In computed axial tomography systems, detectors must detect x-ray photons efficiently and with a high degree of spatial resolution. In some systems, the x-ray source is pulsed and the pulsed repetition rate can be limited by the recovery time of the x-ray detectors. It is desirable to use x-ray detectors which have fast recovery time, high sensitivity, and fine spatial resolution. In multicell detectors, it is also important for each cell to have identical and stable detecting characteristics.

In some tomography systems, the x-ray beam is fan-shaped and diverges as it exits from the examination subject whereupon the beam falls on the array of detector cells such that photon intensities over the leading front of the beam can be detected and resolved spatially. As the x-ray source and detector orbits around the examination subject jointly, the x-ray intensities across the diverging beam projected from the source are detected by the individual detector cells and corresponding analog electric signals are produced. The individual detector cells are arranged in a stack or array so that the x-ray photon distribution across the beam at any instant are detected simultaneously. The signals correspond with x-ray absorption along each ray path at the instant of detection. Additional sets of signals are obtained for the several angular positions of the orbiting detector and x-ray source. The discrete analog signals are converted to digital signals and are processed in a computer which is controlled by a suitable algorithm to produce signals representative of the absorption by each small volume element in the examination subject through which the fan-shaped x-ray beam passes.

To get good spatial resolution, it is desirable to have the electrode plates, which comprise each cell, spaced closely and uniformly over the entire length of the detector. A detector which has advanced achievement of these results is disclosed in U.S. Pat. No. 4,119,853, entitled "Multicell X-ray Detector" to Shelley, et al., and is assigned to the assignee of the present application. The detector in the cited patent comprises a plurality of adjacent, but slightly spaced apart, electrode plates standing edgewise so as to define gas filled gaps between them in which ionization events, that is, the production of the electron-ion pairs due to photon interaction with the gas, may take place. Improved spacing and dimensional tolerances are achieved by securing the electrode plates in a unitary electrode assembly. The structure of the cited detector comprises a pair of flat metal bars which are curved in their planes and constitute a segment of a circle to form the upper and lower frame for the assembly. The bars are substantially congruent with each other in spaced apart parallel planes. There are spacers between the ends of the bars to maintain their spacing. Similarly, curved insulating members which support the electrode plates are bonded to the facing sides of the respective bars. The insulating members have circumferentially spaced regularly extending grooves machined in them. Grooves in opposite members lie on the same radii. The upper and lower edges of an array and electrode plates are inserted in corresponding grooves in the respective insulating members. Alternate electrode plates are connected together and then connected to a common potential source and are called the bias electrodes. The signal electrodes, constituting the electrode plates intervening between every other bias electrode plate, have their own individual connections leading to a data signal acquisition system, which is exterior of the detector. The unitary electrode assembly is disposed within a pressure vessel or chamber which has an internal channel that is curved complementarily with the electrode assembly. In the cited patent, the assembly is securely anchored to the bottom of the channel by screwing down the lower curved bar to the chamber. The front wall of the chamber has a relatively thin section, constituting an x-ray transmissive window. A cover is secured to the chamber to close the open top of the channel, and a sealing gasket is disposed between the cover and the chamber. Means are provided for pressurizing the interior of the chamber with a high atomic weight gas, such as xenon, at about 25 atmospheres to adapt the detector for use with x-rays adding photon energy in the range of up to 120 kilo electron volts.

A particular problem associated with the detector of the prior art results from high frequency mechanical vibration and is known as microphonics. The electrode plates are made of extremely thin metal and must operate in close proximity with a relatively large potential difference between them. Mechanical vibrations can be transmitted through the gas chamber to the electrode assembly and to the electrode plates. Such vibrations may significantly vary the capacitance between electrodes and can introduce microphonic current changes, which are detected in the current sensing electronics, and which cause errors in the x-ray intensity measurements. These spurious microphonic currents are in the picoampere range, but are comparable to the x-ray induced signal and have been erroneously measured as signals in prior art detectors even though no x-ray photons were present.

Another particular problem associated with the detector of the prior art results from low frequency distortions due to thermal variations to the chamber over the operating range of the detector. The thermal expansion of the chamber can create relative distortion between the chamber and the electrode assembly and can transmit the distortion to the electrode plates to again significantly vary the capacitance between the electrodes and introduce microphonic currents which may cause errors in the x-ray intensity measurements.

SUMMARY OF THE INVENTION

An object of the present invention is to overcome the above noted disadvantages and to provide a multicell x-ray detector that does not exhibit spurious signal currents due to microphonics.

Another object of the invention is to provide a multicell x-ray detector which maintains its specified characteristics despite substantial thermal variations.

A feature of the invention is to provide a free floating electrode assembly which is spring mounted within a gas filled chamber to thereby dampen mechanical vibrations and minimize microphonics. The free floating electrode assembly also permits thermal expansion and distortion of the chamber without distortion to the electrode assembly.

In accordance with the present invention, a multicell x-ray radiation detector includes a chamber for confining a gas that produces electron-ion pairs incidental to absorbing radiation. The chamber is formed by a channel having a bottom and sidewalls, one of the side walls having a window for admitting radiation to the chamber. A multicell unitary electrode assembly is mounted within the chamber. The assembly includes a plurality of electrode plates secured in juxtaposed spaced apart relationship by having one pair of opposed edges engaged in corresponding grooves in an upper and lower insulating member. The plates also have front edges and spaces between the plates, constituting cells for being occupied by the gas. An upper compressed elastic member is interposed between the electrode assembly and the chamber and, similarly, a rear compressed elastic member is interposed between the assembly and the sidewall opposite the window of the chamber. The compressed elastic members precisely position the electrode assembly as a unit relative to the window of the chamber. The compressed elastic members allow the electrode assembly to be relatively free to float as a unit during mechanical vibration and thermal distortion of the chamber to thereby reduce microphonics. A cover is provided to seal the electrode assembly within the chamber. The chamber is filled with high atomic weight, ionizable gas at high pressure. Electric circuits are provided from the plates of the unitary electrode assembly to the exterior of the chamber. The compressed elastic members interposed between the electrode assembly and the chamber isolate the electrode assembly from any mechanical vibration and thermal distortion of the chamber while maintaining a precise position of the electrode assembly to the chamber window.

BRIEF DESCRIPTION OF THE DRAWINGS

While the novel features of the invention are set forth with particularity in the appended claims, the invention will be better understood, along with other features thereof, from the following detailed description taken in conjunction with the drawings in which:

DESCRIPTION OF THE PREFERRED EMBODIMENTS

Figure 1:
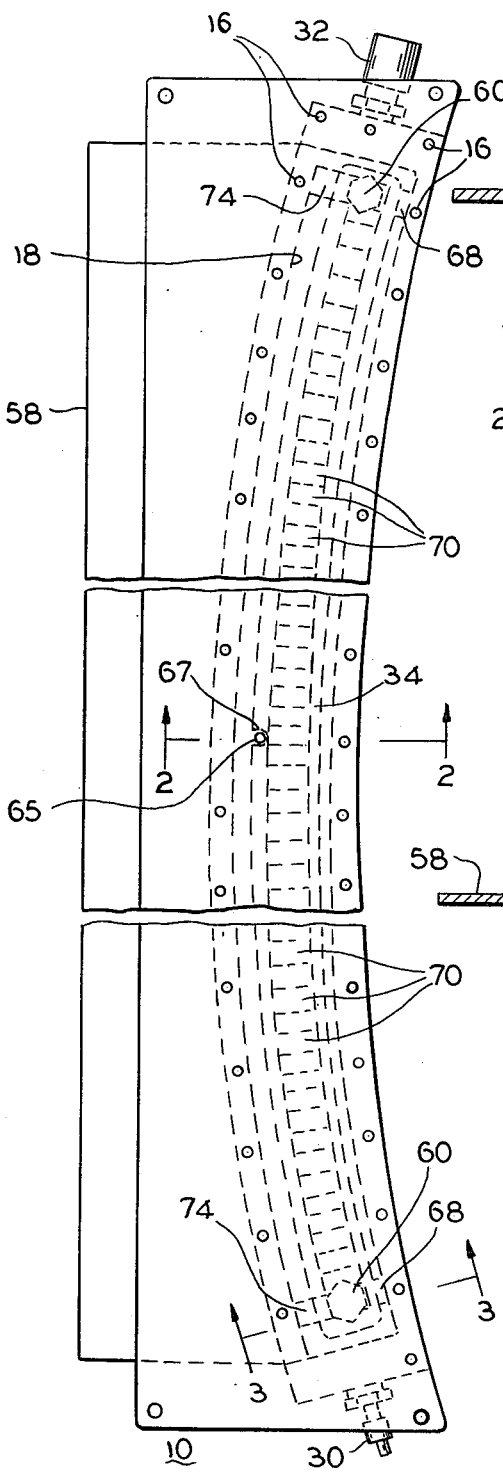
FIG. 1 is a plan view of the multicell detector with the electrode assembly and biasing means of the present invention shown in phantom.

Referring to FIG. 1, there is shown the front elevation of the multicell detector 10 commonly used in computed axial tomography systems. The width of the detector is usually about the same as the width of the x-ray beam whose differential photon intensities are to be detected. The curvature of the detector generally corresponds to a radius equi-distance from the x-ray source (not shown) of the system. However, the detector can also function in a substantially straight configuration. The detector may be used in any physical orientation.

Figure 2:
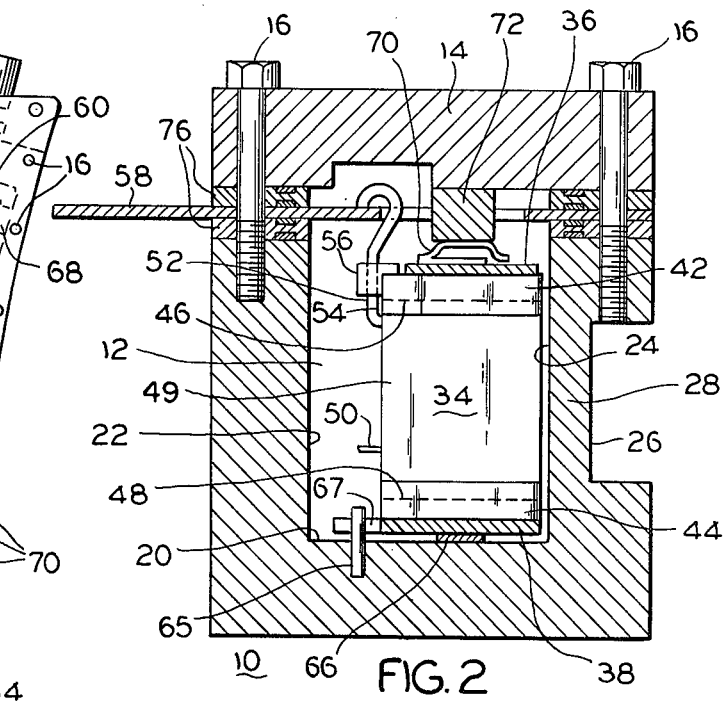
FIG. 2 is an enlarged sectional view taken along line 2—2 of FIG. 1, showing particularly the upper biasing means of the present invention.
Figure 3:
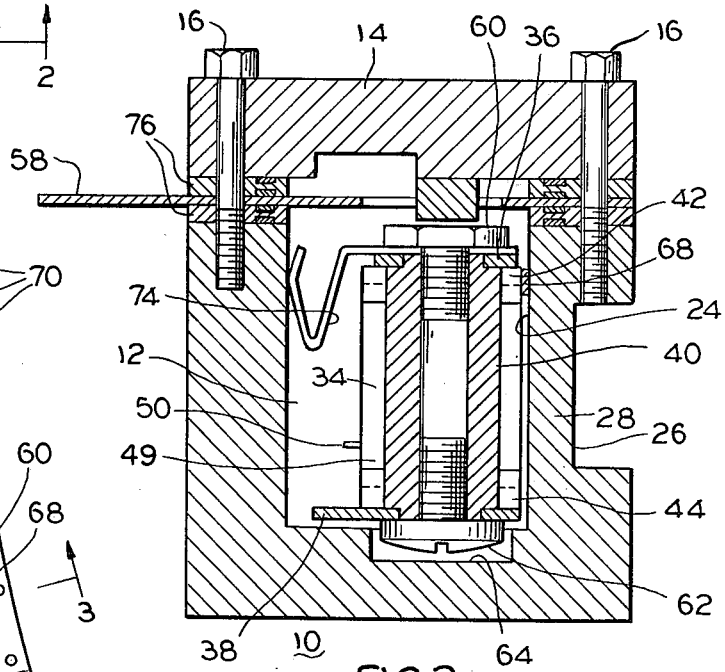
FIG. 3 is an enlarged sectional view taken along line 3—3 of FIG. 1, showing particularly the rear biasing means of the present invention.

Referring also to FIGS. 2 and 3, the multicell detector 10 comprises a body or chamber 12 and a cover 14. The cover is secured to the body with a plurality of cap screws 16. In a commercial embodiment, chamber 12 is a single piece of aluminum in which a curved channel is machined. In FIG. 1, the curved channel is shown by the dashed line marked 18. The curved channel defines a bottom 20, a rear wall 22 and a front wall 24 of the chamber 12. The curved front wall 24 of chamber 12 has an elongated recess 26 milled in it. This provides a relatively thin front wall section that serves as an x-ray permeable window 28 which is thin enough to absorb little of the high energy photons at the energies used in computed tomography, but the window is thick enough to resist the high gas pressure which exists in the chamber.

A fitting 30, essentially a valve, is fitted into one end of chamber 12 for enabling the interior of the chamber to be evacuated and for filling it with ionizable gas. A pressure transducer 32 is secured in another end of the chamber which enables measuring gas pressure in the chamber at any time by using electric conductivity indicating means.

A multicell unitary electrode assembly 34 is shown positioned within chamber 12. The detailed description of the fabrication and operation of the electrode assembly is fully described in U.S. Pat. No. 4,119,853 entitled "Multicell X-Ray Detector" to Shelley, et al., and is incorporated herein by reference.

The multicell electrode assembly is shown in section in FIGS. 2 and 3 (and shown particularly in FIG. 4 of the Shelley, et al. patent). In general terms, the electrode assembly 34 comprises a pair of flat metal bars 36 and 38 which are curved in their planes and constitute a segment of a circle. The bars are disposed substantially congruently with each other in spaced apart parallel planes. There are spacers 40 between the ends of the bars 36 and 38 to maintain their spacing. The metal bars and spacers constitute a frame for the assembly 34. The frame retains an upper insulating member 42 of a suitable insulating material which in this embodiment is a curved bar of ceramic. There is also a similarly curved lower ceramic member 44. Each of the ceramic members has corresponding radial grooves milled into the inner face, shown as dashed line 46 and 48. The radial grooves 46 and 48 are adapted to received a plurality of juxtaposed, circumferentially spaced apart and radially directed electrode plates 49 along substantially the entire length of the detector. The end electrode and every alternate electrode plate is connected together by a common wire or ribbon 50 spot welded to each plate. The alternate electrode plates, which are connected in common, have a high bias voltage applied to them during operation and are called the bias electrodes. The alternate electrodes between each bias electrode are referred to as signal electrode plates. During operation, discrete electric current signals are taken from each of the signal electrode plates. Each of the signal electrode plates has its own lead wire, such as 52 and 54, spot-welded to it and extending upward from each plate. Each wire passes through an L-shaped slotted strip 56 which is bonded to the insulating member 42 by a suitable adhesive, such as epoxy resin. Strip 56 is fabricated from a material available under the Dupont trademark Delrin. The fine signal wires, such as 52 and 54, from alternate signal electrode plates pass upward through alternating shallow and deep slots in member 56 for the purpose of imparting rigidity and stiffness to these fine wires and to assure that they are not bent during the process of connecting them during assembly. Each of the signal wires, such as 52 and 54, are connected to a printed circuit board 58 which is described in detail in U.S. Pat. No. 4,161,655 entitled "Multi-Cell Detector Using Printed Circuit Board," to Cotic, et al., and is assigned to the assignee of the present application.

The thin signal and bias electrode plates 49 are preferably made of stiff high atomic number metal having high x-ray absorption, thus avoiding permeation of x-radiation from one gas filled cell to another, called "Cross Talk," which degrades spatial resolution of the detector. The metal plate is matched with other metals having appropriate thermal coefficients of expansion to avoid uneven expansion and distortion that might result from temperature changes of the electrode assembly. Typical of the illustrated embodiment, enough plates are used to create 320 ionization cells which comprise the gas filled spaces bound by adjacent pairs of electrodes comprising a signal electrode and a bias electrode. in one commercialized design, the electrode plates are tungsten 6 mils (0.006 inches) thick. Since they are set in radial or diverging grooves in ceramic members 42 and 44, their front edges at the x-ray entry ends of the cells are separated by 36 mils and their rear edges by 37 mils. In future designs, more grooves for thinner plates can be fitted into a given length of the ceramic members and more individual cells then can be created over a given length. increasing the number of active ionization cells results in increased capability of the detector to resolve discrete x-ray absorption information which results. In higher resolution and definition in the visual image that is produced by computed image reconstruction. Use of four mil thick electrode plates is held in view and it is expected that about 50% more cells than with the above given dimensions can be created. Tungsten, tantalum or alloys of tantalum and tungsten are desirable metals for the electrode plates because of their stiffness and high atomic numbers, but other high atomic numbers may also be used.

The upper and lower edge of each electrode plate 48 is securely bonded into each of the corresponding grooves 46 and 49 of the insulating members 42 and 44 by a viscous resin coating, such as an epoxy. The upper insulating member 42 has the face opposite its grooved face, bonded by means of a suitable adhesive, such as epoxy resin, to the upper curved bar 36. Similarly, lower insulating member 44 is bonded to the lower curved bar 38. The curved bars 36 and 38 are preferably made of a stainless steel in the 416 series for various reasons, including enabling thermal matching of the detector parts with the particular ceramic elements chosen. Of course, other material combinations are possible.

The upper curved bar 36 and lower curved bar 38 are further maintained in parallel and in spaced relationship with each other by the end spacers 40, shown particularly in FIG. 3. The end spacer 40 has an axial internally threaded hole for receiving the stem of a cap screw 60 for clamping top bar 36 to the spacer. Spacer 40 also has an axial internally threaded hole for receiving the stem of a round headed machine screw 62 which clamps the lower bar 38 to the spacer. A similar cap screw and round headed screw clamp the upper bar and lower bar, respectively, to a similar spacer at the other end of the assembly. The bottom 20 of chamber 12 has a suitable recess 64 at each end to provide clearance so that the head of machine screw 62 does not interfere with the chamber. For the sake of thermal matching, spacers 40 are perferably molybdenum, with electrode plates of tungsten or tantalum and the curved support bars for the ceramic insulating members of stainless steel. Referring again to FIGS. 1, 2 and 3, in accordance with the present invention, the electrode assembly 34 is supported within chamber 12. The invention departs from the referenced patent to Shelley, et al. in the way the electrode assembly is secured within the chamber. The electrode assembly is generally centered within the length of the chamber by a vertical pin 65 projecting from the bottom of the chamber. Lower curved bar 38 has a lateral slotted aperture 67 adapted to receive pin 65. The pin and slot arrangement generally centers the electrode assembly within the chamber and allows the electrode assembly to freely float in the vertical direction along the pin and in the front-to-back direction along the slot.

A bottom spacer is interposed between the bottom of electrode assembly 34 and the bottom 20 of chamber 12. The bottom spacer is formed from a flexible material, such as Mylar, and is approximately 0.030 inches thick and approximately 0.375 inches wide. The bottom spacer 66 extends along the entire bottom of the chamber, generally centered under the electrode assembly 34. To facilitate assembly, the bottom spacer consists of several straight sections which are truncated into an arc, generally conforming to the center of the detector assembly.

A pair of front spacers 68 having approximate dimensions of 0.030 inches thick, 0.250 inches in height and 0.500 inches in length, are interposed at each end of the electrode assembly between the upper insulating member 42 and the window 28 of the chamber 12. To assure that the front spacers 68 remain in position and for ease of assembly, the spacers are bonded by a suitable adhesive, such as epoxy, to the front edge surface of the upper insulating member 42. In alternate embodiments, spacers 66 and 68 could be directly formed into the components of electrode assembly 34 or into the configuration of chamber 12 to support the electrode assembly in the desired position relative to the window.

A biasing means is provided for elastically positioning the electrode assembly 34 against the bottom spacers 66 and against the front spacers 68 to position the electrode assembly in precise relationship to the window of the chamber.

A suitable biasing means for urging the electrode assembly against the bottom spacers 66 is shown in FIGS. 1 and 2 as a plurality of finger leaf springs 70 interposed between the electrode assembly and truncated cover 14. The plurality of springs 70 are truncated along the entire length of the electrode assembly and provide an even distribution of force against the bottom spacer. The particular spring arrangement provides a force of 2 pounds per linear inch of finger spring and thereby provides approximately 60 pounds of downward force over the detector length of 30 inches. A suitable spring is available from Instruments Specialty Company, Little Falls, N.J., under part no. 97-500. A cover extension member 72 is shown attached to cover 14 to compress springs 70. Cover extension member 72 could be easily fabricated as part of the cover, but is fabricated into two pieces to conserve material. In alternate embodiments, a variety of compressable elastic materials, such as cellular plastics or other spring configurations, could be employed to provide a suitable force to elastically urge the detector assembly against the bottom of the chamber.

A suitable biasing means for urging the electrode assembly against the front spacer 68 is provided by a pair of cantilevered leaf springs 74 attached to the ends of upper curved bar 36 by cap screws 60. The leaf springs 74 are fabricated from 302 stainless steel approximately 0.025 inches thick and approximately 0.500 inches wide and is contoured to exert a force of ten pounds each on the electrode assembly. In alternate embodiments a variety of compressable elastic materials and spring configurations could be employed to exert a suitable force on the electrode assembly to elastically position the electrode assembly against the front of the chamber. The arrangement of springs 70 and 74 and their associated forces are for exemplary purposes only and are not intended to be a limitation on the concept of the invention. The precise arrangement and force requirements of a particular system will be determined by the individual weights, dynamics and vibration of that system. The arrangement of springs 70 and 74 can be readily attached to the electrode assembly prior to inserting the assembly into the chamber. The finger leaf springs 70 come with an adhesive bond on the lower surface for permanent attachment to the upper surface of bar 36 and, as previously mentioned, the cantilever leaf springs 74 are attached to the electrode assembly by cap screws 60. Upon installation, the slotted aperture 67 of lower curved bar 38 is positioned over pin 65 and springs 74 are compressed and inserted into the chamber which urges the electrode assembly and front spacers against the window 28 of the chamber. The printed circuit board 58, cover seals 76 and the cover 14 are then positioned over the detector assembly. When the cap screws 16 are securely fastened, cover extension member 72 engages the plurality of springs 70 to urge the detector assembly against the bottom spacers 66 and center the electrode assembly relative to window 28.

An important feature of the detector is that the elastic positioning of the electrode assembly allows it to freely flow as a unit within the chamber even though the chamber may be undergoing severe vibration, torsion and thermal distortion. The spacing and movement of the individual electrodes is relatively constant and microphonics is significantly reduced.

Another important feature of the design is the establishment of a uniform distance and gap between the front edges of the electrode plates and the window 28 of the chamber. With vibration and distortion of the chamber, there can be relative displacement of the unitary electrode assembly relative to the chamber 12. If there are variations between the front edges of the electrode plates and the window, the path traversed by incoming photons on their way to the spaces between electrodes or the cells, would vary. This means that even with uniform photon intensity being applied to the cells through the window, their output signals would have different magnitudes because an indeterminate number of photoelectron-ion pair signals would be created at an irregular gap where they are not collected as usable signals. The elastic positioning and supporting arrangement is designed to always orient the unitary electrode assembly in precise relationship with the window of the chamber, and to freely float in regard to the remaining structure of the chamber.

While a specific embodiment of the present invention has been illustrated and described herein, it is realized that modifications and changes will occur to those skilled in the art. It is, therefore, to be understood that the appended claims are intended to cover all such modifications and changes as fall within the true spirit and scope of the invention.

What is claimed is:

1. An elongate multicell radiation detector comprising:

a chamber for containing gas that produces electron-ion pairs incidental to absorbing radiation, said chamber having top, bottom, front and rear walls, with the front wall having a window for admitting radiation into said chamber;

an electrode assembly and positioning means for supporting said electrode assembly within said chamber, said positioning means comprising a bottom spacer interposed between said electrode assembly and the bottom of said chamber, a front spacer interposed between said electrode assembly and the window of said chamber, an upper compressed elastic member interposed between said electrode assembly and the top wall of said chamber, and a rear compressed elastic member interposed between said electrode assembly and the rear wall of said chamber, whereby said electrode assembly is elastically positioned against said front spacer and said bottom spacer in precise relationship to the window of said chamber; and means for establishing electric circuits from said electrode assembly to the exterior of said chamber.

2. The detector as in claim 1 wherein said upper compressed member comprises a plurality of springs.

3. The detector as in claim 1 wherein said rear compressed member comprises a plurality of springs.

4. The detector as in claim 1 wherein said electrode assembly includes an upper and a lower insulating member and a plurality of electrode plate means secured in juxtaposed spaced apart relationship by having their opposed edges engaged in said upper and lower insulating member and constituting cells for being occupied by said gas adjacent the window of said chamber.

5. An elongate multicell X-radiation detector comprising:

a chamber for confining a gas that produces electron-ion pairs incidental to absorbing radiation, said chamber having bottom and side walls, one of said walls having a window for admitting radiation to said chamber;

a unitary electrode assembly for being mounted in said chamber, said assembly including a unitary frame, an upper insulating member and a lower insulating member within said frame, a plurality of electrode plates secured in juxtaposed spaced apart relationship by having one pair of opposed edges engaged in corresponding grooves of said upper and lower insulating members, respectively, said plates also having front edges and spaces between said plates constituting cells for being occupied by said gas;

a cover for sealingly closing said chamber; and biasing means for elastically supporting said unitary electrode assembly in precise relationship to the window of said chamber, wherein said biasing means includes an upper compressed elastic member interposed between said assembly and said cover of said chamber, and a rear compressed elastic member interposed between said assembly and the side wall opposite said window, whereby said assembly is precisely positioned as a unit relative to said window of said chamber and is relatively free to float as a unit during mechanical vibration and thermal distortion of said chamber;

means for establishing electric circuits from said plates of said unitary electrode assembly to the exterior of said chamber.

6. The detector as in claim 5 wherein said upper compressed member and said rear compressed member include a plurality of springs.

7. In a radiation detector of the type having an elongate chamber for containing ionizable gas under pressure and an electrode assembly positioned therein, an improved positioning means for supporting the electrode assembly within the chamber comprising: spring members disposed on two sides of said electrode assembly between the electrode assembly and the internal walls of the chamber for elastically positioning the electrode assembly in a precise position within the chamber and allowing the chamber to undergo mechanical and thermal vibrations without an associated distortion of the electrode assembly, said biasing means being composed of a non-plastic material.

8. The improved positioning means of claim 7 wherein said two electrode assembly sides are adjacent to each other.

9. A positioning means as set forth in claim 7 and including spacer elements positioned adjacent the other two electrode assembly sides to maintain the separation between the electrode assembly and the internal walls of the chamber.

* * * * *